US008950744B1

(12) United States Patent
Chen et al.

(10) Patent No.: US 8,950,744 B1
(45) Date of Patent: Feb. 10, 2015

(54) PAPER FEEDING MECHANISM

(71) Applicant: Foxlink Image Technology Co., Ltd., New Taipei (TW)

(72) Inventors: Kuan Ting Chen, New Taipei (TW); Wen Ching Liao, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 14/156,793

(22) Filed: Jan. 16, 2014

(51) Int. Cl.

| | |
|---|---|
| ***B65H 1/08*** | (2006.01) |
| ***B65H 5/06*** | (2006.01) |
| ***B65H 3/06*** | (2006.01) |
| ***B65H 7/02*** | (2006.01) |

(52) U.S. Cl.
CPC ..... *B65H 5/068* (2013.01); *B65H 3/0669* (2013.01); *B65H 3/0615* (2013.01); *B65H 7/02* (2013.01)
USPC ..... 271/147

(58) Field of Classification Search
USPC ..... 271/147, 152, 153, 157, 160, 258.01, 271/265.01, 114
See application file for complete search history.

(56) References Cited

U.S. PATENT DOCUMENTS

| | | | | |
|---|---|---|---|---|
| 6,485,015 | B2 * | 11/2002 | Yen et al. | 271/121 |
| 2009/0295065 | A1 * | 12/2009 | Kondo | 271/10.01 |
| 2011/0210497 | A1 * | 9/2011 | Hochreiter | 271/18 |

FOREIGN PATENT DOCUMENTS

| | | | |
|---|---|---|---|
| JP | 3-216424 | * | 9/1991 |
| JP | 4-80130 | * | 3/1992 |

* cited by examiner

*Primary Examiner* — Thomas Morrison
(74) *Attorney, Agent, or Firm* — WPAT, P.C.; Anthony King; Kay Yang

(57) ABSTRACT

A paper feeding mechanism includes a frame, a drive assembly mounted to the frame, an input tray, a pickup assembly driven by the drive assembly, an elevating assembly and a control assembly. A front end of the input tray is pivoted to the frame, a bottom of the input tray has a pressing portion. The elevating assembly includes a gear assembly driven by the drive assembly, a rotating shaft driven by the gear assembly and located under the input tray, and an elastic element against the bottom of the input tray. The rotating shaft has a cam portion thereon and a notch formed between two ends of the cam portion. The control assembly includes a control system and a paper sensor detecting whether there is any paper on the input tray and control the drive assembly to drive the elevating assembly and the pickup assembly.

5 Claims, 6 Drawing Sheets

PAPER FEEDING MECHANISM

BACKGROUND OF THE INVENTION

1. Field of the Invention

The present invention relates to a paper feeding mechanism, and more particularly to a paper feeding mechanism capable of picking up papers steadily.

2. The Related Art

A conventional paper feeding mechanism includes an input tray and a pickup assembly. The pickup assembly is mounted to the input tray and located above the input tray. After papers are put on the input tray, a motor drives the input tray to rise to a fixed height according to the thickness of the papers. Then the pickup assembly starts to pick up the papers. However, the total thickness of the papers becomes thinner and thinner after the pickup assembly picks up the papers for a while, the input tray is still located at the constant level, which weakens positive force exerted on the papers by the pickup assembly. So, the pickup assembly can't pick up the papers effectively.

SUMMARY OF THE INVENTION

Accordingly, an object of the present invention is to provide a paper feeding mechanism. The paper feeding mechanism includes a frame as a supporting structure of the paper feeding mechanism, a drive system, an input tray, a pickup assembly, an elevating assembly and a control assembly. The drive assembly is mounted to the frame. The input tray is used for holding papers thereon, a front end of the input tray is pivoted to the frame, a bottom of the input tray has a pressing portion protruded at a portion thereof. The pickup assembly is driven by the drive assembly and located above the input tray. The elevating assembly is mounted to the frame, the elevating assembly includes a gear assembly driven by the drive assembly, a rotating shaft driven by the gear assembly and located under the input tray, and an elastic element against the bottom of the input tray. The rotating shaft has a cam portion thereon and a notch formed between two ends of the cam portion. The rotating shaft is capable of rotating to make the cam portion press downward the pressing portion of the input tray so as to drive the input tray to swing downward or make the pressing portion depart from the cam portion to be located in the notch to enable the elastic element push the input tray upwards by a restoring force thereof. The control assembly includes a control system and a paper sensor, the paper sensor detects whether there is any paper on the input tray and transmits a signal to the control system in order to control the drive assembly to drive the elevating assembly and the pickup assembly.

As described above, the rotating shaft has a cam portion thereon and a notch formed between two ends of the cam portion. The rotating shaft is capable of rotating to make the cam portion press downward the pressing portion of the input tray so as to drive the input tray to swing downward for facilitating placing papers on the input tray. Furthermore, when the rotating shaft rotates to make the pressing portion depart from the cam portion to be located in the notch, the elastic element can elastically push the input tray upwards by a restoring force thereof to modulate the rising height of the input tray at any time to ensure the pickup roller of the pickup assembly to press downward on the papers with a stable positive force to proceed the pickup action so as to make the pickup assembly pick up the papers on the input tray steadily.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
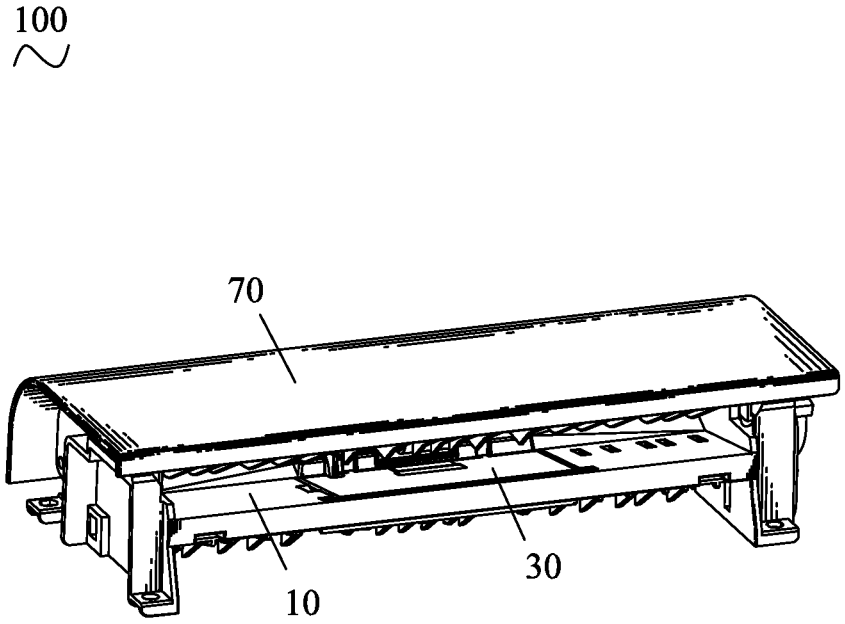
FIG. 1 is an assembled, perspective view of a paper feeding mechanism in accordance with the present invention.
Figure 2:
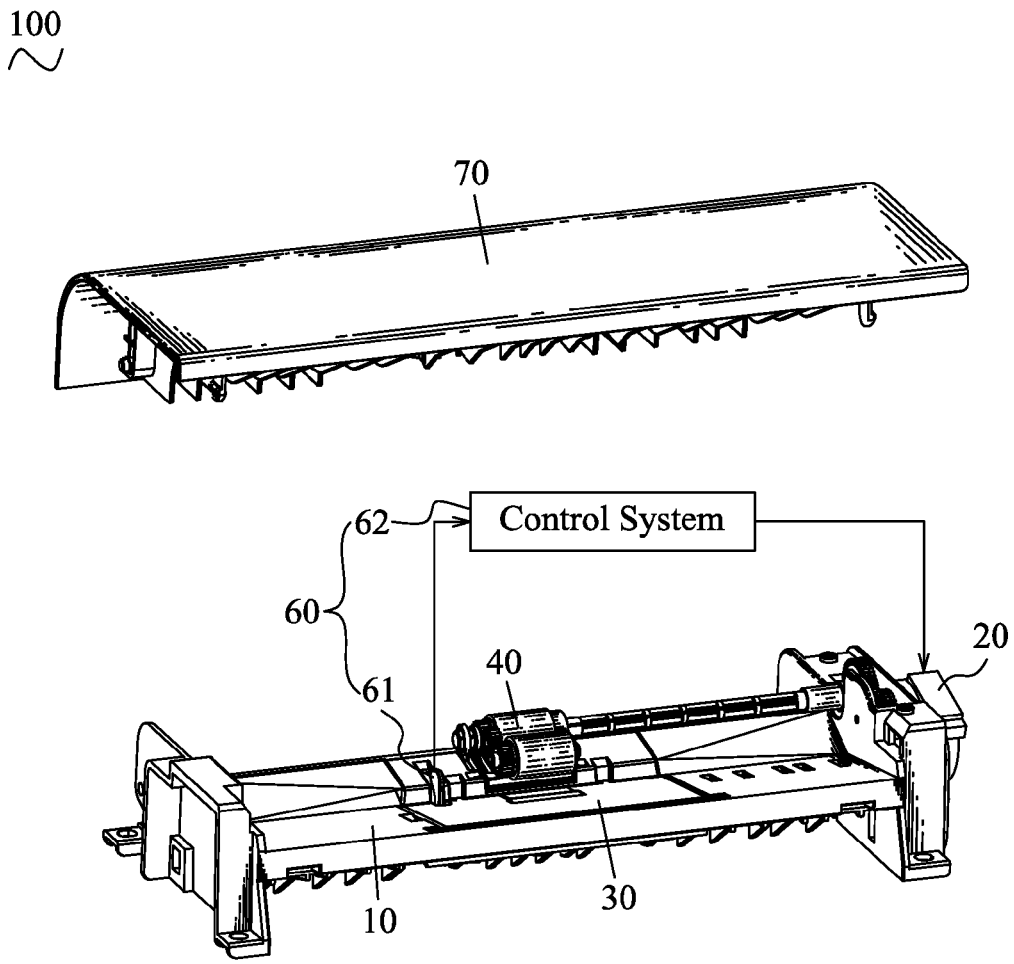
FIG. 2 is a partial exploded, perspective view of the paper feeding mechanism of FIG. 1.
Figure 3:
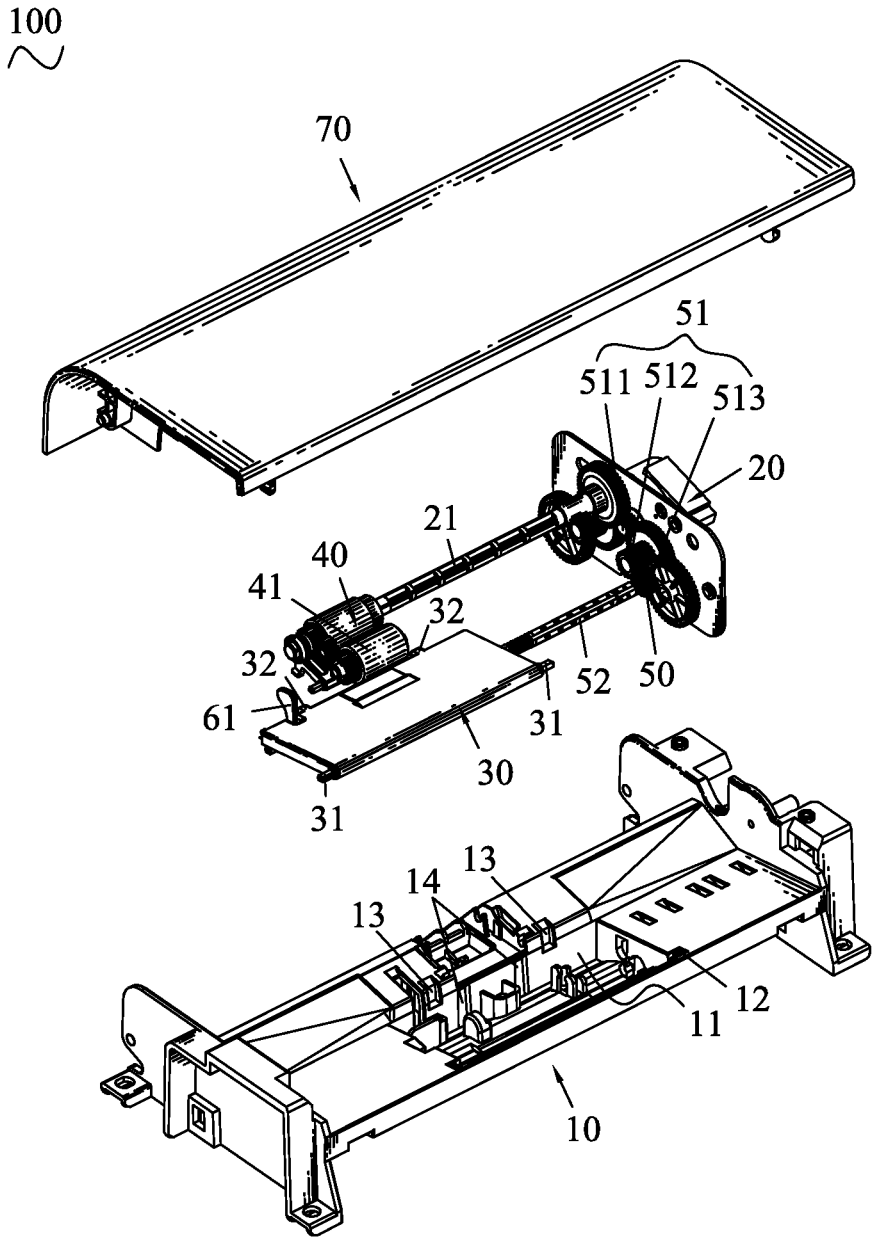
FIG. 3 is an exploded, perspective view of the paper feeding mechanism of FIG. 1.
Figure 4:
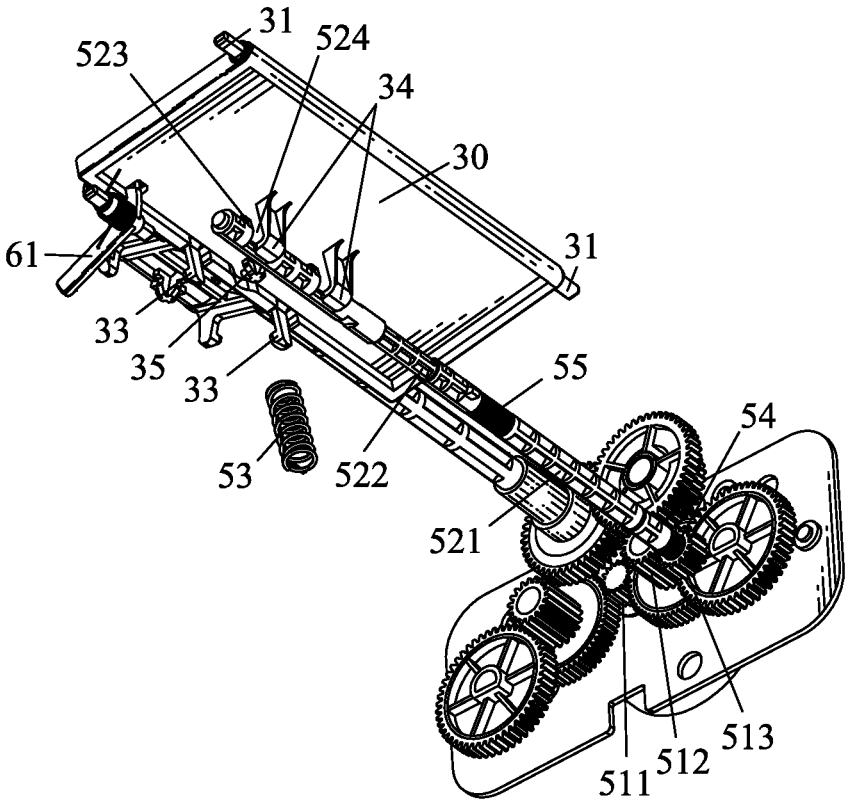
FIG. 4 is another partial exploded perspective view of the paper feeding mechanism of FIG. 1.

Referring to FIG. 1, FIG. 2, FIG. 3 and FIG. 4, a paper feeding mechanism 100 in accordance with the present invention is shown. The paper feeding mechanism 100 includes a frame 10 as a supporting structure of the paper feeding mechanism 100, a drive assembly 20 mounted to the frame 10, an input tray 30, a pickup assembly 40, an elevating assembly 50, a control assembly 60 and a cover 70. The drive assembly 20, the input tray 30, the pickup assembly 40 and the elevating assembly 50 are respectively assembled to the frame 10.

Referring to FIG. 1, FIG. 2, FIG. 3 and FIG. 4, a middle of the frame 10 opens an accommodating groove 11 penetrating through a top thereof. Two opposite sides of the accommodating groove 11 define two pivoting holes 12 at front ends thereof, a rear end of the accommodating groove 11 defines two grooves 13 and two holding cavities 14 between the two grooves 13.

The input tray 30 is used for loading a stack of papers thereon. A front end of the input tray 30 is pivoted to the frame 10 and a rear end of the input tray swings upward around the front end of the input tray 30 to be raised up a distance from the frame 10. Specifically, the input tray 30 is accommodated in the accommodating groove 11, two opposite sides of the front end of the input tray 30 extend oppositely to form two pivoting pillars 31 pivoted in the two pivoting holes 12 of the frame 10. The rear end of the input tray 30 extend rearward to form two stoppers 32 which are disposed in the grooves 13 and capable of rising and descending within the grooves 13. The rear end of the input tray 30 extends downward, and then extends rearward to form two hook portions 33 located between the two stoppers 32. The two hook portions 33 are held in the holding cavities 14. Two portions of a bottom of the input tray 30 extend downward and then extend rearward to form two pressing portions 34 located in front of the hook portions 33. The bottom of the rear end of the input tray 30 protrudes downward to form a fastening pillar 35 located between the two pressing portions 34.

The drive assembly 20 is mounted to one side of the frame 10 and includes a drive shaft 21. The pickup assembly 40 is driven by the drive assembly 20. The pickup assembly 40 is mounted to the frame 10 by the drive shaft 21 and is located over the rear end of the input tray 30. The pickup assembly 40 includes a pickup roller 41 connected to one end of the drive shaft 21.

The elevating assembly 50 includes a gear assembly 51 mounted to one side of the frame 10, a rotating shaft 52 driven by the gear assembly 51 and located under the input tray 30, and an elastic element 53. The gear assembly 51 includes a driving gear 511 connected to the drive assembly 20, a driven gear 512 engaging with the driving gear 511, and a spindle gear 513 engaging with the driven gear 512. The rotating shaft 52 includes a first shaft 521 with one end thereof mounted to the spindle gear 513 and a second shaft 522 with one end thereof mounted to the other end of the first shaft 521. The second shaft 522 has two cam portions 523 formed thereon and two notches 524 formed between two ends of the corresponding cam portions 523. The elevating assembly 50 also includes a first torsion spring 54 mounted between the first shaft 521 and the spindle gear 513 and a second torsion spring 55 mounted between the first shaft 521 and the second shaft 522. One end of the elastic element 53 resists against the frame 10 and the other end of the elastic element 53 is disposed on the fastening pillar 35 to restrain the elastic element 53 between the frame 10 and the input tray 30.

The control assembly 60 includes a control system 62 and a paper sensor 61. The paper sensor 61 detects whether there is any paper on the input tray 30 and transmitting a signal to the control system 62 in order to control the drive assembly 20 to drive the elevating assembly 50 and the pickup assembly 40. Specifically, the paper sensor 61 is mounted on the input tray 30 with one end thereof projecting beyond a top surface of the input tray 30. The paper sensor 61 has a sensing portion (not shown) which can emit a light, the paper on the input tray 30 can obstruct the emitted light by the sensing portion, therefore, a detecting signal is generated to be transmitted to the control system 62.

Figure 5:
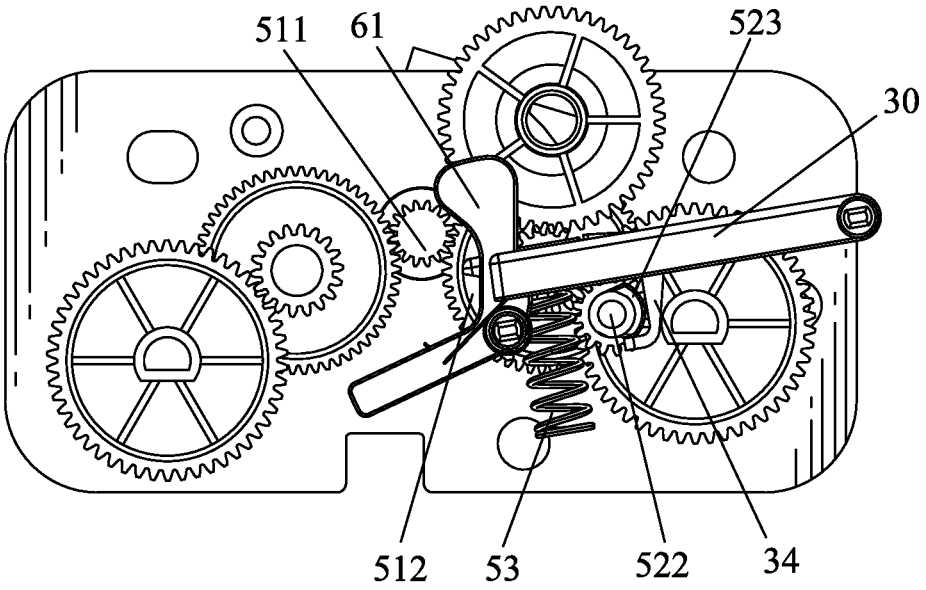
FIG. 5 is a lateral view showing that the paper feeding mechanism of FIG. 1 is ready to place papers on an input tray thereof.
Figure 6:
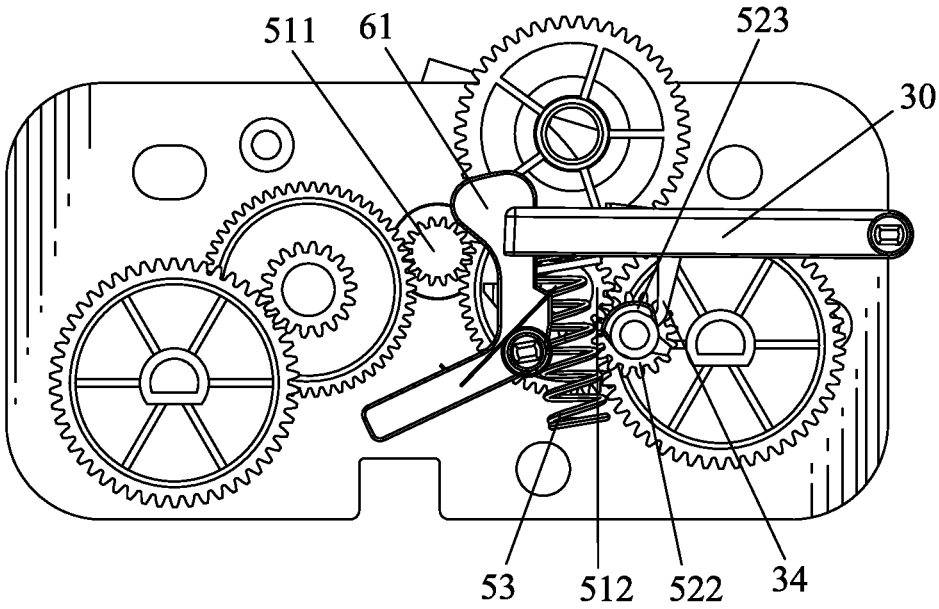
FIG. 6 is a lateral view showing that the paper feeding mechanism of FIG. 1 is in a pickup status.

Referring to FIG. 5 and FIG. 6, working principle of the paper feeding mechanism 100 is described as follows. When there is no paper placed on the input tray 30, the pickup assembly 40 keeps a raised status, the elastic element 54 pushes against the input tray 30 to swing upward to the highest position, the stoppers 32 are accommodated in the grooves 13 and spaced a distance from a bottom of the grooves 13. When the paper feeding mechanism 100 is started, the drive assembly 20 drives the driving gear 511, the driving gear 511 further transmits the driving force to the driven gear 512 and the spindle gear 513, and then the spindle gear 513 transmits the driving force to the first shaft 521 by the first torsion spring 54, the first shaft 521 further transmits the driving force to the second shaft 522 by the second torsion spring 55. The rotation of the second shaft 522 makes the two cam portions 523 of the rotating shaft 52 press downward the pressing portions 34 of the input tray 30 so as to drive the input tray 30 to swing downward for facilitating placing the stack of papers on the input tray 30 (shown in FIG. 5). The elastic element 54 is compressed by the input tray 30.

After placing the stack of papers on the input tray 30, the paper obstructs the emitted light by the sensing portion of the paper sensor 61, then the sensing portion generates a detecting signal and transmits the detecting signal to the control system 62. The control system 62 controls the drive assembly 20 rotate anticlockwise to drive the driving gear 511 and further transmits the driving force to the drive gear 512 and the spindle gear 513. The driving force is further transmitted to the first shaft 521 by the first torsion spring 54 and then transmitted to the second shaft 522 by the second torsion spring 55. The rotation of the second shaft 522 make the cam portions 523 rotate to depart from the pressing portions 34 of the input tray 30 and then the pressing portions 34 are placed in the notches 524, at the moment, the elastic element 53 elastically pushes the input tray 30 to swing upward to the pickup position (shown in FIG. 6). Then, the drive assembly 20 drives the pickup assembly 40 to rotate downward to start picking up the paper, the elastic element 53 elastically pushes against the input tray 30 to modulate a raised height of the input tray 30 at any time to ensure the pickup roller 41 of the pickup assembly 40 to press downward on the paper with a stable positive force to proceed the pickup action. When the input tray 30 is pivoted upward at a certain position, the hook portions 33 are held in the holding cavities 14 to make sure that the input tray 30 will not be ejected from the frame 10.

When the pickup action is finished, the paper sensor 61 sends a detecting signal to the control system 62, the control system 62 controls the drive assembly 20 to rotate clockwise again to transmit the driving force to the gear assembly 51 and the rotating shaft 52. The rotation of the second shaft 522 makes the cam portions 523 press the pressing portions 34 of the input tray 30 so as to drive the input tray 30 swing downward for facilitating placing the paper on the input tray 30 next time.

As described above, the rotating shaft 52 defines two cam portions 523 and the two notches 524 formed between two ends of the cam portions 523. The rotating shaft 52 is capable of rotating to make the cam portions 523 press downward the pressing portions 34 of the input tray 30 so as to drive the input tray 30 to swing downward for facilitating placing papers on the input tray 30. Furthermore, when the rotating shaft 52 rotates to make the pressing portions 34 depart from the cam portions 523 to be located in the notches 524, the elastic element 53 can elastically push the input tray 30 upwards by a restoring force thereof to modulate the rising height of the input tray 30 at any time to ensure the pickup roller 41 of the pickup assembly 40 to press downward on the papers with a stable positive force to proceed the pickup action so as to make the pickup assembly 40 pick up the papers on the input tray 30 steadily.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A paper feeding mechanism, comprising:

a frame as a supporting structure of the paper feeding mechanism;

a drive assembly mounted to the frame;

an input tray for holding papers thereon, a front end of the input tray being pivoted to the frame, a bottom of the input tray having a pressing portion protruded at a portion thereof;

a pickup assembly driven by the drive assembly and located above the input tray;

an elevating assembly mounted to the frame, the elevating assembly including a gear assembly driven by the drive assembly, a rotating shaft driven by the gear assembly and located under the input tray, and an elastic element against the bottom of the input tray, the rotating shaft having a cam portion thereon and a notch formed between two ends of the cam portion, the rotating shaft being capable of rotating to make the cam portion press downward the pressing portion of the input tray so as to drive the input tray to swing downward or make the pressing portion depart from the cam portion to be located in the notch to enable the elastic element push the input tray upwards by a restoring force thereof; and a control assembly including a control system and a paper sensor, the paper sensor detecting whether there is any paper on the input tray and transmitting a signal to the control system in order to control the drive assembly to drive the elevating assembly and the pickup assembly;

wherein the gear assembly is mounted to one side of the frame, the gear assembly includes an driving gear connected with the drive assembly, a driven gear engaging with the driving gear, a spindle gear engaging with the driven gear and connected with the rotating shaft;

wherein the rotating shaft includes a first shaft with one end thereof connected to the spindle gear and a second shaft connected to the other end of the first shaft, the cam portion is formed on the second shaft, the elevating assembly further includes a first torsion spring mounted between the first shaft and the spindle gear and a second torsion spring mounted between the first shaft and the second shaft.

2. The paper feeding mechanism as claimed in claim 1, wherein a middle of the frame opens an accommodating groove penetrating through a top thereof, two opposite sides of the accommodating groove define two pivoting holes at front ends thereof, two opposite sides of the front end of the input tray extend oppositely to form two pivoting pillars, the two pivoting pillars are pivoted in the two pivoting holes of the frame.

3. The paper feeding mechanism as claimed in claim 2, wherein a rear end of the accommodating groove defines two grooves, a rear end of the input tray extend rearward to form two stoppers which are disposed in the grooves and capable of rising and descend within the grooves.

4. The paper feeding mechanism as claimed in claim 2, wherein a rear end of the accommodating groove defines two holding cavities, a rear end of the input tray extends downward, and then extends rearward to form two hook portions held in the holding cavities.

5. The paper feeding mechanism as claimed in claim 1, wherein the bottom of the input tray protrudes downward to form a fastening pillar at a portion thereof, one end of the elastic element resists against the frame and the other end of the elastic element is disposed on the fastening pillar.

* * * * *